US010204755B2

(12) United States Patent
Zhou et al.

(10) Patent No.: US 10,204,755 B2
(45) Date of Patent: Feb. 12, 2019

(54) THERMAL TRIP COMPENSATION STRUCTURE

(71) Applicant: Schneider Electric Industries SAS, Rueil-Malmaison (FR)

(72) Inventors: Junjie Zhou, Shanghai (CN); Zhenzhong Liu, Shanghai (CN); Yibo Li, Shanghai (CN); Junchang Shi, Shanghai (CN); Zakaria Boughalem, Shanghai (CN)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 15/634,062

(22) Filed: Jun. 27, 2017

(65) Prior Publication Data

US 2017/0372858 A1 Dec. 28, 2017

(30) Foreign Application Priority Data

Jun. 27, 2016 (CN) ..... 2016 2 0649005 U

(51) Int. Cl.
*H01H 37/52* (2006.01)
*H01H 71/40* (2006.01)
(Continued)

(52) U.S. Cl.
CPC ..... *H01H 37/52* (2013.01); *H01H 71/40* (2013.01); *H01H 71/7436* (2013.01);
(Continued)

(58) Field of Classification Search
CPC ..... H01H 37/52; H01H 2239/06
(Continued)

(56) References Cited

U.S. PATENT DOCUMENTS 3,260,825 A * 7/1966 Owen ..... H01H 71/162 337/102
3,950,714 A * 4/1976 Mrenna ..... H01H 71/40 335/35
(Continued)

FOREIGN PATENT DOCUMENTS

CN 203103245 U 7/2013
CN 203339084 U 12/2013
(Continued)

OTHER PUBLICATIONS

English Language Machine Translation of Chinese Patent Application Publication No. CN203339084U, published on Dec. 11, 2013, 5 pages.
(Continued)

*Primary Examiner* — Anatoly Vortman
(74) *Attorney, Agent, or Firm* — Locke Lord LLP

(57) ABSTRACT

The present disclosure relates to a thermal trip compensation structure including a tripping bar having an ejector pin, a bimetal strip, a compensating component, a support for the compensating component, and an adjustment component. One end of the bimetal strip is connected with the support. The support receives and supports the compensating component. The adjustment component is capable of adjusting a position of the compensating component relative to the support. The compensating component has an inclined slant surface which is set in such a way that a gap between the inclined slant surface and the ejector pin of the tripping bar when the bimetal strip is deflected after the occurrence of short circuit is less than the gap between the inclined slant surface and the ejector pin of the tripping bar when the bimetal strip is not deflected before the occurrence of the short circuit.

5 Claims, 4 Drawing Sheets

(51) Int. Cl.
*H01H 71/74* (2006.01)
*H01H 71/16* (2006.01)

(52) U.S. Cl.
CPC ... *H01H 71/7445* (2013.01); *H01H 2071/168* (2013.01); *H01H 2239/06* (2013.01)

(58) Field of Classification Search
USPC ..... 337/82
See application file for complete search history.

(56) References Cited

U.S. PATENT DOCUMENTS

| | | | | |
|---|---|---|---|---|
| 5,317,471 | A * | 5/1994 | Izoard | H01H 69/01 324/417 |
| 5,894,259 | A * | 4/1999 | Kolberg | H01H 71/121 335/10 |
| 6,104,273 | A * | 8/2000 | Larranaga | H01H 71/7427 200/286 |
| 6,445,274 | B1 * | 9/2002 | Malingowski | H01H 71/7445 335/202 |
| 6,661,329 | B1 * | 12/2003 | Gibson | H01H 71/7427 335/35 |
| 6,816,055 | B2 * | 11/2004 | Weber | H01H 71/7436 335/144 |
| 7,135,953 | B2 * | 11/2006 | Leitl | H01H 71/7436 337/84 |
| 7,714,692 | B2 * | 5/2010 | Lee | H01H 71/7445 335/145 |
| 7,821,376 | B2 * | 10/2010 | Song | H01H 69/01 335/145 |
| 9,530,601 | B2 * | 12/2016 | Alcantara Gonzalez | H01H 5/18 |
| 2014/0139302 | A1 | 5/2014 | Rubbo | |
| 2015/0248985 | A1 | 9/2015 | Augusta et al. | |
| 2017/0323753 | A1 * | 11/2017 | Lee | H01H 71/7427 |

FOREIGN PATENT DOCUMENTS

| | | | |
|---|---|---|---|
| CN | 105390350 | A | 3/2016 |
| EP | 0338868 | | 10/1989 |
| EP | 0710973 | | 5/1996 |
| RU | 2136074 | C1 | 8/1999 |
| RU | 2145134 | C1 | 1/2000 |
| RU | 2524402 | C2 | 7/2014 |
| SU | 516121 | | 5/1976 |

OTHER PUBLICATIONS

English Language Machine Translation of Chinese Patent Application Publication No. CN203103245U, published on Jul. 31, 2013, 6 pages.
English Language Machine Translation of Chinese Patent Application Publication No. CN105390350A, published on Mar. 9, 2016, 7 pages.
Extended European Search Report for European Patent Application No. 17305789.4 dated Nov. 16, 2017, 7 pages.
Russian Office Action for Russian Patent Application No. 2017122307/07 dated Oct. 9, 2017, 5 pages.
English Language Translation of Russian Office Action for Russian Patent Application No. 2017122307/07 dated Oct. 9, 2017, 3 pages.
English Language Machine Translation of European Patent Application Publication No. EP0338868 dated Oct. 25, 1989, 10 pages.
English Language Translation of Abstract of Russian Patent Application Publication No. RU2136074C1 dated Aug. 27, 1999, 1 page.
English Language Translation of Abstract of Russian Patent Application Publication No. RU2524402C2 dated Jul. 27, 2014, 1 page.
English Language Translation of Description of Soviet Union Patent Application Publication No. SU516121 dated May 30, 1976, 3 pages.
Decision on Grant of Russian Patent Application No. 2017122307/07 dated Mar. 6, 2018, 6 pages.
English Language Translation of Decision on Grant of Russian Patent Application No. 2017122307/07 dated Mar. 6, 2018, 4 pages.
English Language Translation of Abstract of Russian Patent Application Publication No. RU2145134C1 dated Jan. 27, 2000, 1 page.

* cited by examiner

THERMAL TRIP COMPENSATION STRUCTURE

BACKGROUND

The present disclosure relates to a thermal trip compensation structure, and particularly to a thermal trip compensation structure used after a short circuit test.

As illustrated in FIG. 1, a bimetal strip 2 is subjected to large thermal deformation in a 15 A short-circuit test, so that it is fixed against a tripping bar 1. This will then cause the bimetal strip 2 to undergo plastic deformation. When returning to a normal temperature, the gap between the bimetal strip 2 and an ejector pin 1-1 of the tripping bar 1 will be larger than that before the test, so the thermal-tripping will have a greater requirement for deformation of the bimetal strip 2, and the tripping will also occur correspondingly late.

In addition, since a certain amount of contamination, such as metal particles, is ejected at the time of a short circuit, the coefficient of friction between the tripping bar 1 and a driving hammer is significantly increased, so that the tripping will also become more difficult.

SUMMARY

In order to overcome the above deficiencies in the prior art, that is, the thermal-tripping after the short-circuit test having a greater requirement for the deformation of the bimetal strip, and the tripping also occurring correspondingly late, as well as the contamination, such as metal particles, being ejected at the time of the short circuit significantly increasing the coefficient of friction between the tripping bar and the driving hammer, the present disclosure proposes a thermal trip compensation structure capable of adjusting the distance between the bimetal strip and the ejector pin of the tripping bar after the short-circuit test, thereby achieving compensation for the thermal-tripping and effectively solving the matter that, after the short-circuit test, the tripper is slow to trip or can not be tripped on time.

According to one aspect of the present disclosure, a thermal trip compensation structure is provided; the thermal trip compensation structure comprises a tripping bar having an ejector pin, a bimetal strip, a compensating component, a support for the compensating component, and an adjustment component.

One end of the bimetal strip is connected with the support for the compensating component.

The support for the compensating component receives and supports the compensating component.

The adjustment component is capable of adjusting the position of the compensating component relative to the support for the compensating component.

The compensating component has an inclined slant surface, the inclined slant surface is set in such a way that a gap between the inclined slant surface and the ejector pin of the tripping bar upon the bimetal strip being deflected after the occurrence of short circuit is less than the gap between the inclined slant surface and the ejector pin of the tripping bar upon the bimetal strip being not deflected before the occurrence of the short circuit.

The inclined slant surface inclines toward a direction in which the bimetal strip is deflected after the short circuit.

The support for the compensating component is provided with support grooves.

A guide portion is provided on a side wall of the support groove.

A support aperture is provided on a bottom wall of the support groove.

The compensating component is provided with compensating component grooves located at a side of the compensating component opposite to the inclined slant surface.

The compensating component groove receives a part of the adjustment component.

The compensating component is further provided with a coupling portion.

The coupling portion cooperates with the guide portion so as to achieve movement of the compensating component with respect to the support for the compensating component. Such engagement of the coupling portion with the guide portion ensures a steady movement of the compensating component with respect to the support for the compensating component, and then adjusts the gap between the inclined slant surface and the ejector pin.

The adjustment component is a screw passing through the support aperture to actuate the compensating component, that is to say, the motion of the screw pushes the compensating component to move with respect to the support for the compensating component.

In view of the above solutions, the bimetal strip will deflect after the short circuit, thus by means of the characteristic that the gap between the slant surface feature and the ejector pin of the tripping bar is correspondingly decreased, the adverse effect caused by the bimetal strip deformation and the increasing friction force is thereby compensated for. Which is to say, when returning to a normal temperature, the gap between the bimetal strip and the ejector pin of the tripping bar is unlikely to be greater than that before the short-circuit test, thus the thermal-tripping will not have a greater requirement for the deformation of the bimetal strip, and the tripping also will not occur correspondingly late.

At this point, for a better understanding of the detailed description of the present disclosure herein, and also for a better understanding of the contribution of the present disclosure to the prior art, the present disclosure has broadly summarized the embodiments of the present disclosure. Of course, the embodiment of the disclosure will be described below and will form the subject of the appended claims.

Before explaining in detail the embodiments of the disclosure, it should be understood that, the disclosure is not limited in its application to the details of the structure and the configuration of the components and the equivalent steps proposed in the following description or illustrated in the drawings. The disclosure can encompass embodiments other than those described and can be implemented and carried out in different ways. Furthermore, it is to be understood that the phraseology and terminology used herein are for the purpose of description and should not be construed as limiting.

Likewise, those skilled in the art will recognize that the ideas on which the present disclosure is based may be readily used as a basis for designing other structures, so as to carry out several objects of the present disclosure. It is therefore important that the appended claims is are considered to include such equivalent constructions as long as they do not go beyond the spirit and scope of the present disclosure.

BRIEF DESCRIPTION OF THE DRAWINGS

The present disclosure will be better understood by those skilled in the art from the following drawings, which more clearly embrace the advantages of the present disclosure. The drawings described herein are for illustrative purposes only and are not intended to be exhaustive of the present invention, and are also not intended to limit the scope of the disclosure.

DETAILED DESCRIPTION

In the following, the preferred embodiments according to the present disclosure will be described in detail in conjunction with the drawings. The features and advantages of the disclosure will be apparent to those skilled in the art from the accompanying drawings and corresponding narrative descriptions.

Figure 1:
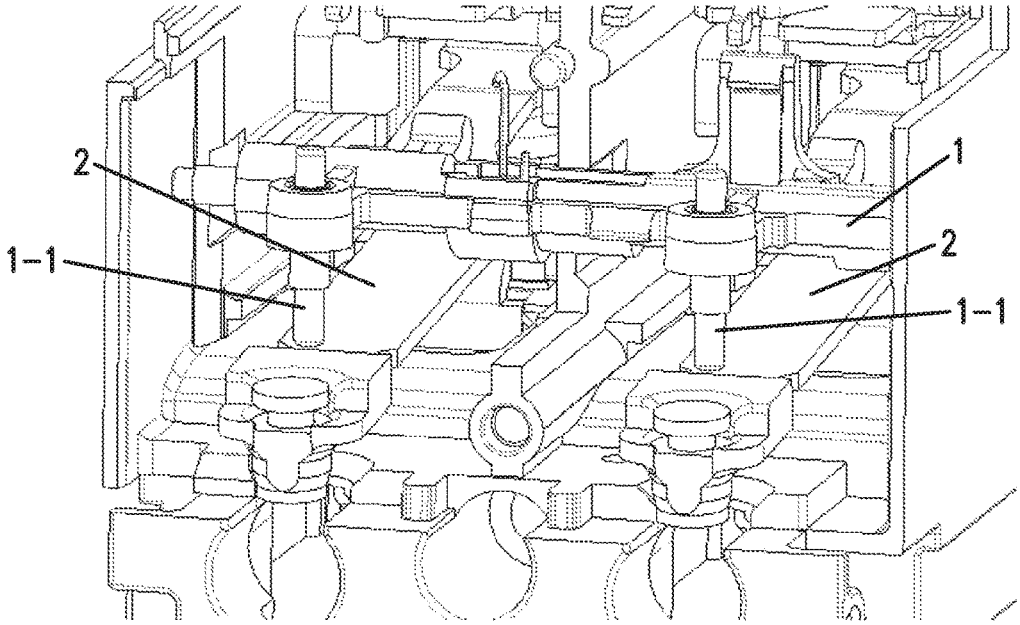
FIG. 1 Prior Art
FIG. 1 illustrates a thermal-tripping structure according to prior art.
Figure 2:
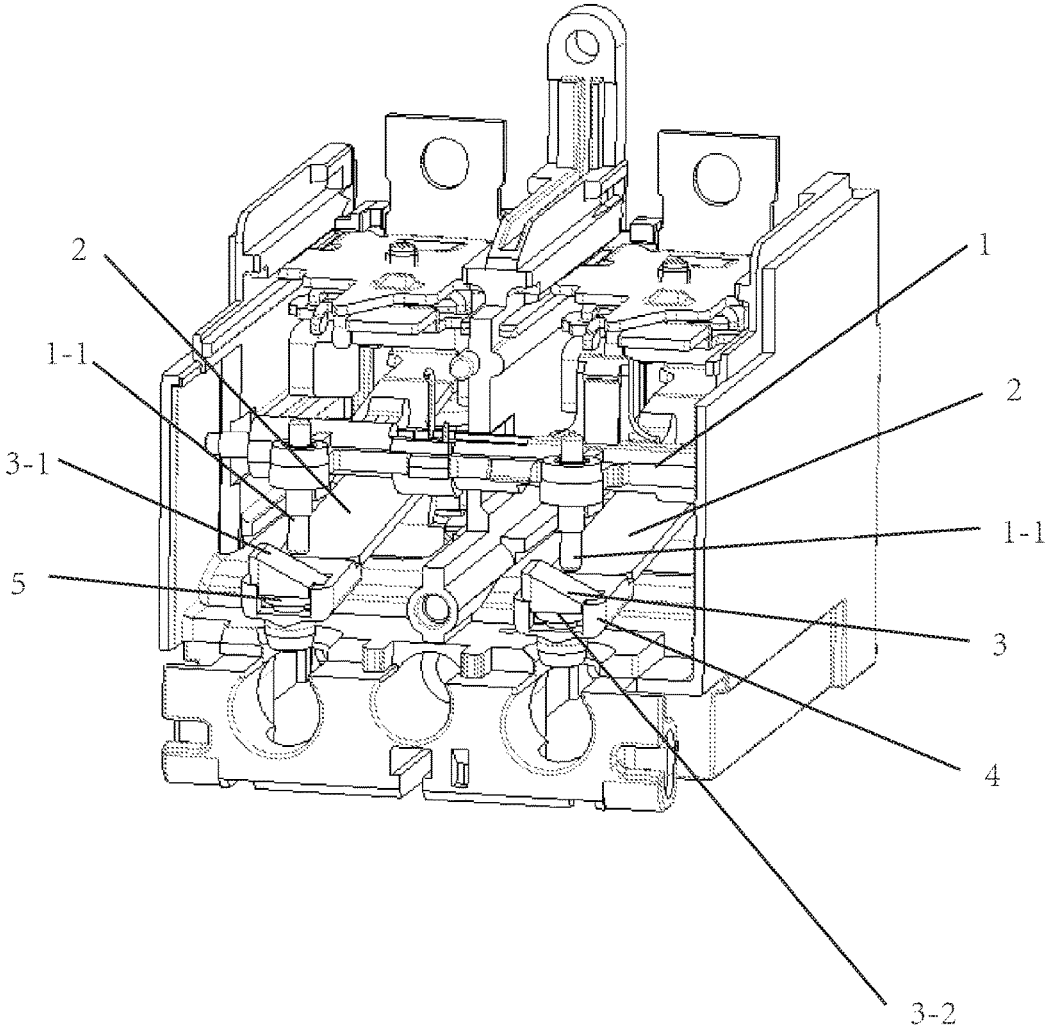
FIG. 2 illustrates a thermal trip compensation structure according to the present disclosure.

FIG. 2 illustrates a thermal trip compensation structure according to the present disclosure, wherein the thermal trip compensation structure comprises a tripping bar 1 having an ejector pin 1-1, a bimetal strip 2, a compensating component 3, a support 4 for the compensating component as well as an adjustment component 5.

One end of the bimetal strip 2 is connected with the support 4 for the compensating component.

The support 4 for the compensating component supports the compensating component 3 and receives a part of the compensating component 3.

The adjustment component 5 can adjust the position of the compensating component 3 relative to the support 4 for the compensating component.

Figure 6:
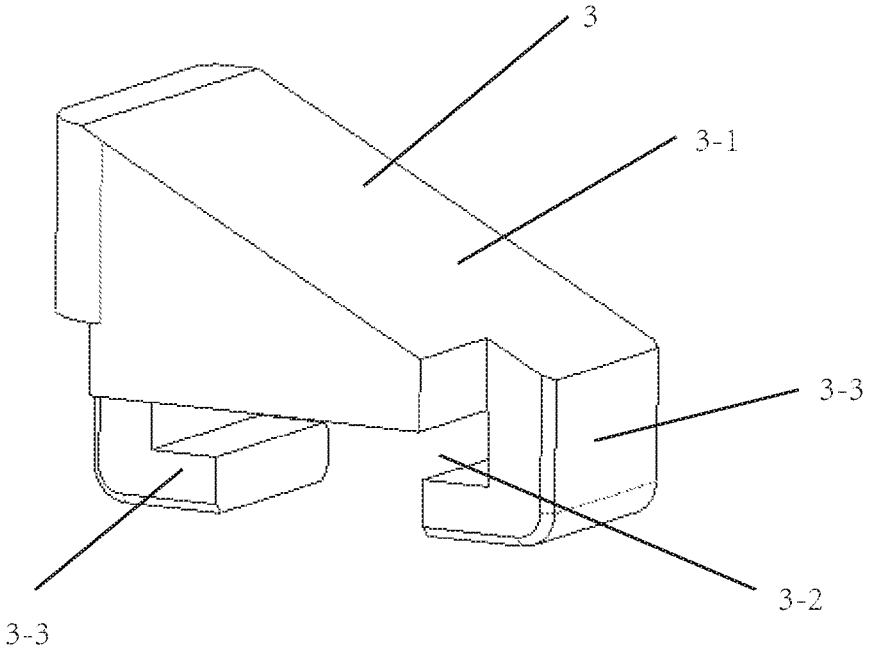
FIG. 6 illustrates the compensating component according to the present disclosure.

As illustrated in FIGS. 2 and 6, the compensating component 3 has an inclined slant surface 3-1, the inclined slant surface 3-1 is set in such a way that the gap between the inclined slant surface 3-1 and the ejector pin 1-1 of the tripping bar 1 when the bimetal strip 2 is deflected after the occurrence of a short circuit is less than the gap between the inclined slant surface 3-1 to the ejector pin 1-1 of the tripping bar 1 when the bimetal strip 2 is not deflected before the occurrence of the short circuit.

The inclined slant surface 3-1 inclines toward the direction in which the bimetal strip deflects after the short circuit. In FIG. 2, the inclined slant surface 3-1 inclines toward the direction in which the bimetal strip deflects rightward after the short circuit.

Figure 3:
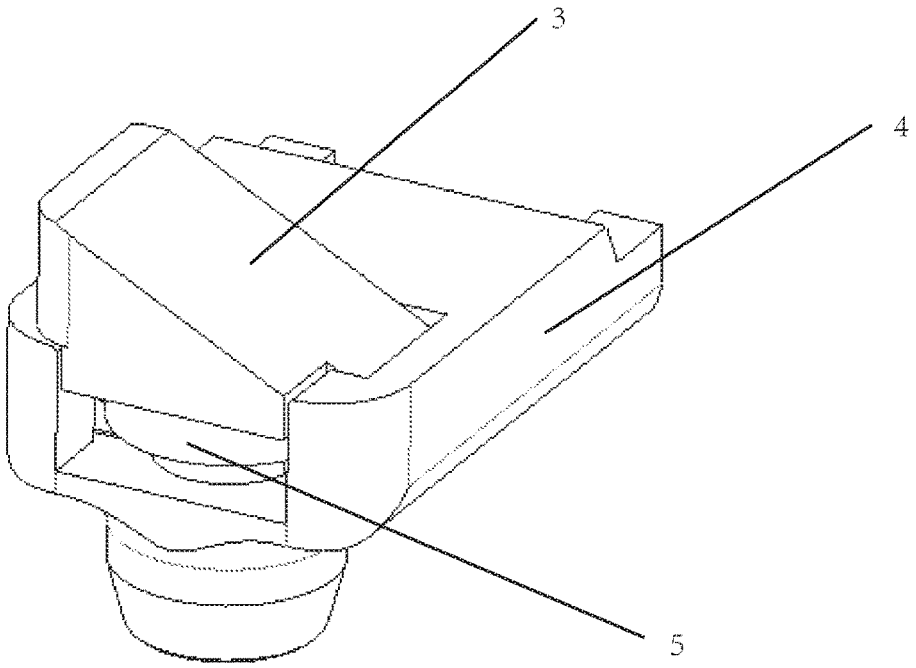
FIG. 3 illustrates an assembly diagram of the compensating component and the support for the compensating component according to the present disclosure.
Figure 4:
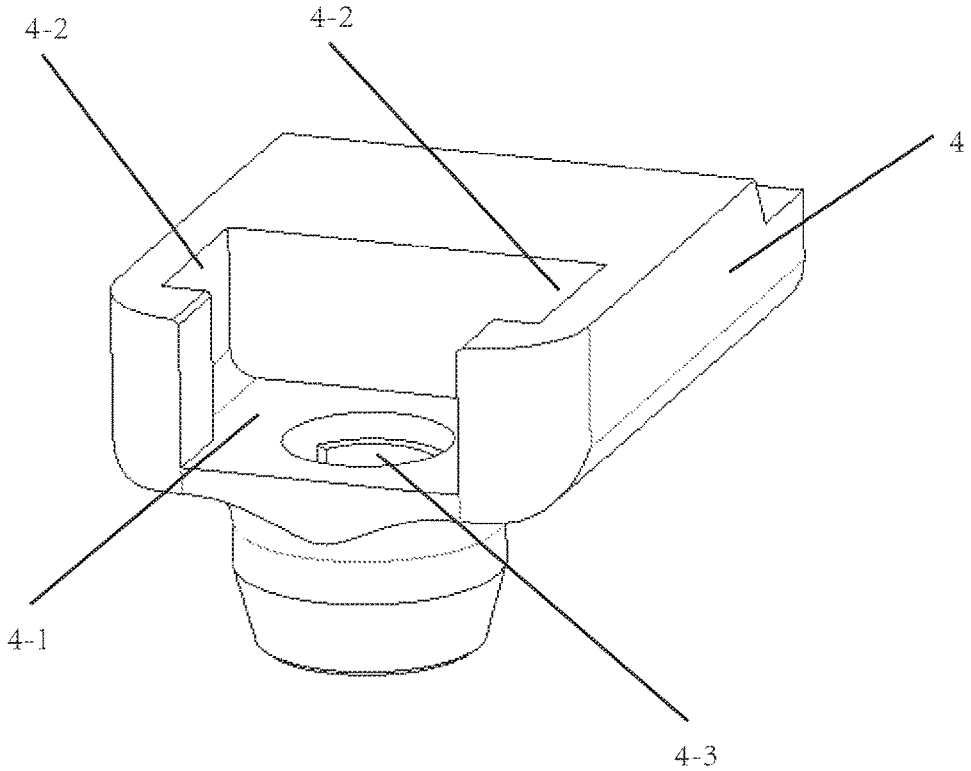
FIG. 4 illustrates the support for the compensating component according to the present disclosure.
Figure 5:
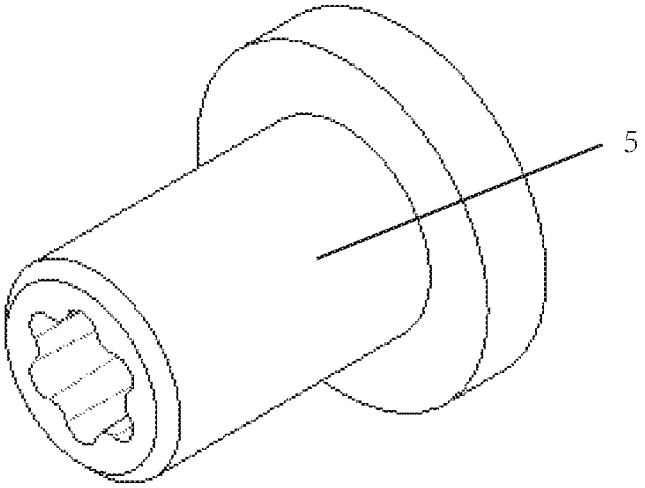
FIG. 5 illustrates the adjustment component according to the present disclosure.

FIG. 3 illustrates an assembly diagram of the compensating component and the support for the compensating component according to the present disclosure, and FIGS. 4 to 6 illustrate the support for the compensating component, the adjustment component, and the compensating component according to the present disclosure respectively. As illustrated in FIG. 4, the support 4 for the compensating component is provided with a support groove 4-1.

A guide portion 4-2 is provided on the side wall of the support groove 4-1.

A support aperture 4-3 is provided on the bottom wall of the support groove 4-1.

As illustrated in FIG. 6, the compensating component 3 is provided with a compensating component groove 3-2, and the compensating component groove 3-2 is provided at a side of the compensating component opposite to the inclined slant surface 3-1.

The compensating component groove 3-2 receives a part of the adjustment component 5.

The compensating component 3 is further provided with a coupling portion 3-3.

The coupling portion 3-3 cooperates with the guide portion 4-2 so as to achieve movement of the compensating component 3 with respect to the support 4 for the compensating component, and in FIG. 3, the coupling portion 3-3 is, for example, a protrusion, and the guide portion 4-2 is a groove. Such engagement of the coupling portion with the guide portion ensures a steady movement of the compensating component 3 with respect to the support 4 for the compensating component, and adjusts the gap between the inclined slant surface 3-1 and the ejector pin 1-1.

As illustrated in FIG. 5, the adjustment component 5 is a screw passing through the support aperture 4-3 to actuate the compensating component 3, that is to say, the motion of the screw pushes the compensating component 3 to move up and down with respect to the support 4 for the compensating component, as illustrated in FIGS. 2 and 3.

As illustrated in FIGS. 2 and 3, the bimetal strip 2 will deflect rightward deflection after the short circuit, thus by means of the characteristic feature (the inclined slant surface 3-1) wherein the gap between the slant surface and the ejector pin 1-1 of the tripping bar 1 decreases correspondingly, the adverse effect caused by the bimetal strip deformation and increasing friction force is thereby compensated for. Which is to say, when returning to a normal temperature, the gap between the bimetal strip 2 and the ejector pin 1-1 of the tripping bar 1 is unlikely to be greater than that before the short-circuit test, and thus the thermal-tripping will not have a greater requirement for the deformation of the bimetal strip, and the tripping also will not be correspondingly late.

Referring to the specific embodiments, although the present disclosure has already been described in the Description and the drawings, it should be appreciated that the skilled person in this art could make various alterations and various equivalent matter could be substituted for various method steps and means therein without departing from the scope of the present disclosure defined by the attached claims. Moreover, the combinations and mating of technical features, elements and/or functions among the specific embodiments herein are clear and well-defined, thus according to these disclosed contents, those skilled in the art will appreciate that the technical features, elements, and/or functions as well as method steps in the embodiments may be incorporated into another embodiment as appropriate unless the foregoing description is otherwise described. In addition, according to the teachings of the disclosure, many alterations can be made to adapt to special situations without departing from the essence of the disclosure. Accordingly, the present disclosure is not limited to the specific embodiments illustrated in the drawings, and the specific embodiments in the specification described as the optimal embodiment conceived for carrying out the present disclosure, but the present disclosure is intended to cover all embodiments falling within the scope of the foregoing specification and the appended claims.

What is claimed is:

1. A thermal trip compensation structure comprising a tripping bar having an ejector pin, a bimetal strip, a compensating component, a support for the compensating component, and an adjustment component, wherein one end of the bimetal strip is connected with the support for the compensating component;

the support for the compensating component receives and supports the compensating component;

the adjustment component is capable of adjusting a position of the compensating component relative to the support for the compensating component; and the compensating component has an inclined slant surface, the inclined slant surface is set in such a way that a gap between the inclined slant surface and the ejector pin of the tripping bar upon the bimetal strip being deflected after occurrence of a short circuit is less than the gap between the inclined slant surface and the ejector pin of the tripping bar upon the bimetal strip being not deflected before the occurrence of the short circuit, and wherein, the support for the compensating component is provided with a support groove;

a guide portion is provided on a side wall of the support groove; and a support aperture is provided on a bottom wall of the support groove.

2. The thermal trip compensation structure according to claim 1, wherein, the inclined slant surface inclines toward a direction in which the bimetal strip is deflected after the short circuit.

3. The thermal trip compensation structure according to claim 1, wherein, the compensating component is provided with a compensating component groove located at a side of the compensating component opposite to the inclined slant surface; and the compensating component groove receives a part of the adjustment component.

4. The thermal trip compensation structure according to claim 3, wherein, the compensating component is further provided with a coupling portion; and the coupling portion cooperates with the guide portion so as to achieve movement of the compensating component with respect to the support for the compensating component.

5. The thermal trip compensation structure according to claim 4, wherein, the adjustment component is a screw passing through the support aperture to actuate the compensating component.

* * * * *